United States Patent [19]

Miyazaki et al.

[11] 3,986,222

[45] Oct. 19, 1976

[54] SHOCK CONTROL DEVICE FOR USE IN THE CONSTRUCTION OF BUILDINGS SUCH AS BRIDGES AND THE LIKE

[75] Inventors: Shusuke Miyazaki, Yasuo Maehara, both of Tokyo; Wataru Abe, Hiratsuka; Ikuo Shimoda, Fujisawa, all of Japan

[73] Assignees: Japanese National Railways; Oiles Industry Co., Ltd.; Yachiyo Engineering Co., Ltd., all of Tokyo, Japan

[22] Filed: Oct. 1, 1975

[21] Appl. No.: 618,551

[30] Foreign Application Priority Data

Dec. 5, 1975 Japan ..... 49-138901

[52] U.S. Cl. ..... 14/16.1; 52/167; 248/20

[51] Int. Cl.[2] ..... E01D 19/06

[58] Field of Search ..... 14/16 B; 52/167; 248/2, 248/20

[56] References Cited

UNITED STATES PATENTS

| | | | |
|---|---|---|---|
| 2,597,800 | 5/1952 | Hussman | 248/20 |
| 3,105,252 | 10/1963 | Milk | 52/167 X |
| 3,218,008 | 11/1965 | Harris | 52/167 X |
| 3,232,015 | 2/1966 | Latham | 52/167 |
| 3,233,376 | 2/1966 | Naillon | 52/167 X |
| 3,459,395 | 8/1969 | Scotto | 248/20 |
| 3,587,787 | 6/1971 | Rich | 248/20 X |
| 3,762,114 | 10/1973 | Eskijian | 52/167 |

FOREIGN PATENTS OR APPLICATIONS

| | | | |
|---|---|---|---|
| 57,872 | 9/1967 | Germany | 14/16 B |
| 1,073,187 | 1/1960 | Germany | 52/167 |

*Primary Examiner*—Nile C. Byers, Jr.
*Attorney, Agent, or Firm*—George B. Oujevolk

[57] ABSTRACT

There is described a control device particularly suitable for use in the construction of buildings such as continuous girder or truss bridges, elevated highways and the like, for the purpose of controlling vertically imposed loads, more particularly, for the purpose of attenuating mechanical vibrations or impacts as will be caused by braking or starting land vehicles or earthquakes, dispersing horizontally an acting forces at the joint of an upper structure of a bridge such as a girder and a lower structure such as a pier, particularly at a fixed shoe (bridge bearing) on the pier.

5 Claims, 8 Drawing Figures

SHOCK CONTROL DEVICE FOR USE IN THE CONSTRUCTION OF BUILDINGS SUCH AS BRIDGES AND THE LIKE

BACKGROUND OF THE INVENTION

This invention relates to a shock control device which is particularly suitable for use in construction of large buildings such as bridges, elevated highways or railways and the like.

In constructing bridges with long girders, it is general practice to support one end of the girder fixedly by a fixed shoe (bridge bearing) and the other end by a movable bearing to absorb elongation or contraction of the girder due to variations in the atmospheric temperature. The bearing at the junction of an upper and lower structure of such bridge, particularly the fixed bearing, is subjected to a great horizontal force at the time of earthquakes since the movable bearing shares the horizontal force only in a small amount comparable to a frictional force. The force imposed on the fixed bearing becomes extremely great with a lengthy or continuous girder.

In this connection, it is known to provide shock controlling devices in the lower work of a bridge in combination with the fixed bearings, the shock controlling devices being designed to show almost no resistance to a very slow motion of the girder or upper structure as experienced during its elongation or contraction due to temperature variations, showing a positive resistance only to an abrupt movement of the girder or upper work as caused by earthquakes to prevent concentration of impacts on the fixed bearings of the lower work.

FIG. 1 shows a vertical cross section of a conventional shock controlling device and FIG. 2 is a transverse cross section of the same device.

Referring to FIGS. 1 and 2, indicated at 1 is a column which is fixed at one end to an upper structure G such as a girder or the like. The other or lower end of the column 1 is received in a casing 2 which is fixedly mounted on or embedded in a lower structure B like a pier, leaving relatively large clearances D on the opposite sides of the column 1 in the axial direction of the bridge and smaller clearances *d* at the sides in the transverse direction of the bridge. The clearances D and *d* between the casing 2 and the column 1 are filled with a viscous material R.

The shock controlling device of FIGS. 1 and 2 utilizes the fluid pressure differential in the viscous material in the clearances D which is generated by the movement of the column 1. A shock control device of this type has a drawback. That is, the surface level of the viscous material in the clearance D into which the column 1 is moved is raised to a certain degree, so that there is a possibility of the viscous material flowing out of the casing 2. If the filling amount of the viscous material in the casing 2 is reduced to prevent such overflowing, it becomes difficult to maintain constant and desired resistance of the viscous material due to trapping of air which exists in the space between the viscous material and the upper end of the casing 2.

A piston-cylinder type shock controlling device is also known in the art, wherein a cylinder is secured to a girder or an upper structure G while a piston rod of a piston which is slidably received in the cylinder is fixed on a pier or a lower structure of the bridge, generating a resistance of fluid pressure within the cylinder in response to the movement of the piston thereby to prevent displacement of the lower work G. The shock control device of this type is disadvantageously complicated in construction and requires high precision work in preparing the respective component parts.

It is an object of the present invention to provide a shock control device which effectively utilizes shearing resistance of a viscous material in absorbing and damping out shocks resulting from an abrupt movement of a girder as caused by braking and starting land vehicles running on a bridge or earthquakes, without generating resistance in response to a slow movement of the girder occurring by elongation or contraction due to temperature variations.

In one particular form of the invention, the shock control device includes a number of resisting plates which are accommodated within a casing and consist of a number of thin movable plates and a number of thin fixed plates positioned opposingly and alternately, the resisting plates having their faces disposed in the axial direction of the bridge. The movable plates are fixedly linked to each other at least at one end and uniformly spaced from each other. Mounted on the fixed ends of the movable plates is a lower-end of a column the other or upper-end of which is securely fixed to a girder or an upper structure of the bridge.

The fixed plates which cooperates with the movable plates may be linked fixedly to each other or may be mounted separately in the respective positions in the casing. The linked or separate fixed plates within the casing are blocked against movement at least in the axial direction of the bridge. As a whole, the small clearances between the movable and fixed plates and the clearances between the resisting plates and the casing are filled with a fluid of high viscosity.

Another object of the present invention is to provide a shock control device which precludes the possibility of trapping air in the viscous material within the casing or the possibility of the viscous material flowing out of the casing.

It is still another object of the present invention to provide a shock control device which is capable of maintaining desired buffering performance quality even if there occur deviations in the relative positions of the movable and fixed resisting plates.

It is a further object of the present invention to provide a shock control device the resistance of which is adjustable by varying interspaces between the movable and fixed resisting plates, that is to say, by varying effective resisting area of the plates with increase or decrease of the number of the plates and varying a viscosity of viscous materials.

The above and other objects, features and advantages of the invention will become apparent from the following description of the invention and the appended claims, taken in conjunction with the accompanying drawings which show by way of example preferred embodiments of the invention.

BRIEF DESCRIPTION OF THE DRAWINGS

In the accompanying drawings

Figure 1:
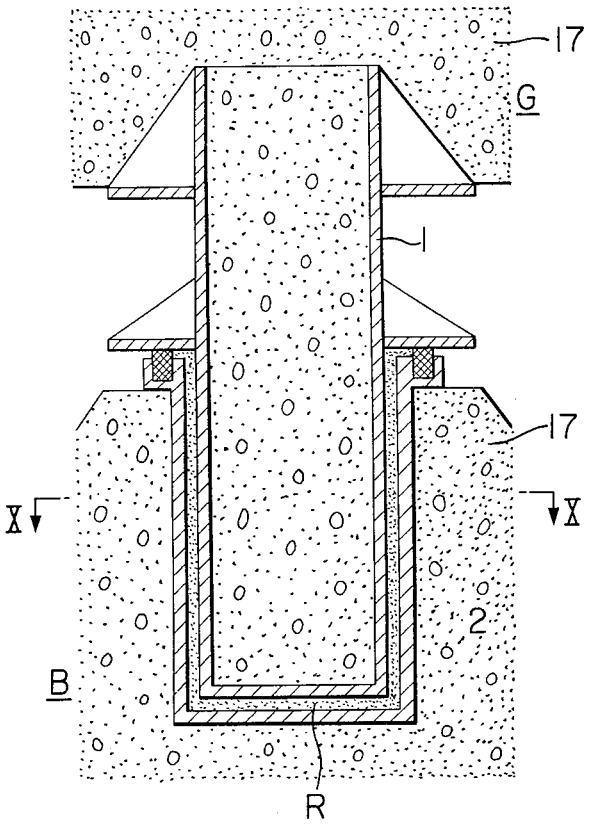
FIG. 1 is a vertical cross section of a shock control device which is currently used in the construction of bridges.
Figure 2:
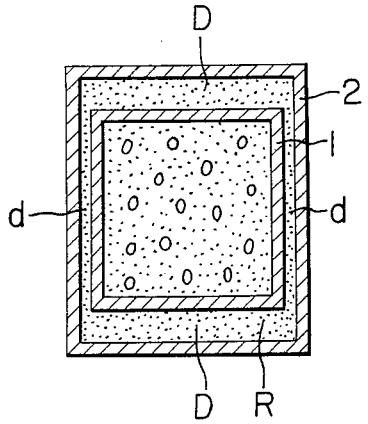
FIG. 2 is a transverse cross section taken on line X — X of FIG. 1.
Figure 3:
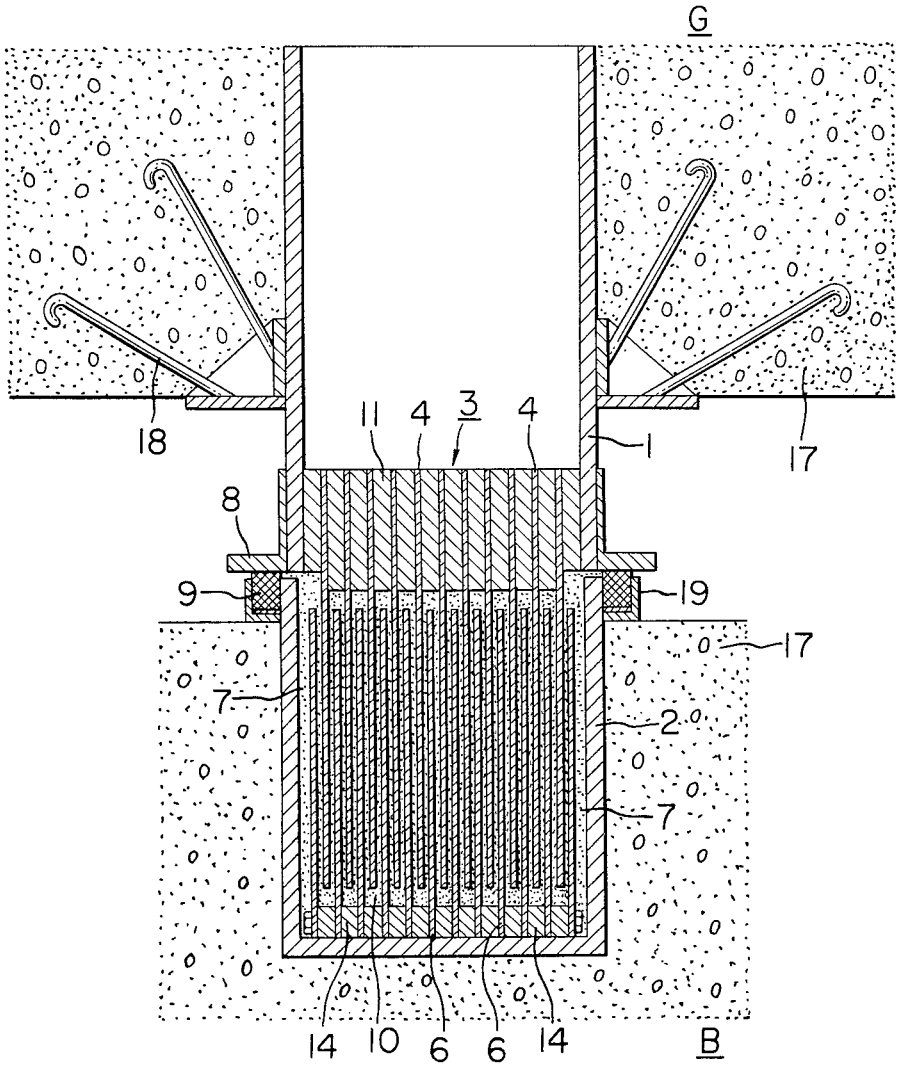
FIGS. 3 and 4 are sectional views of a shock control device embodying the present invention, taken in the transverse and axial direction of the bridge, respectively.
Figure 4:
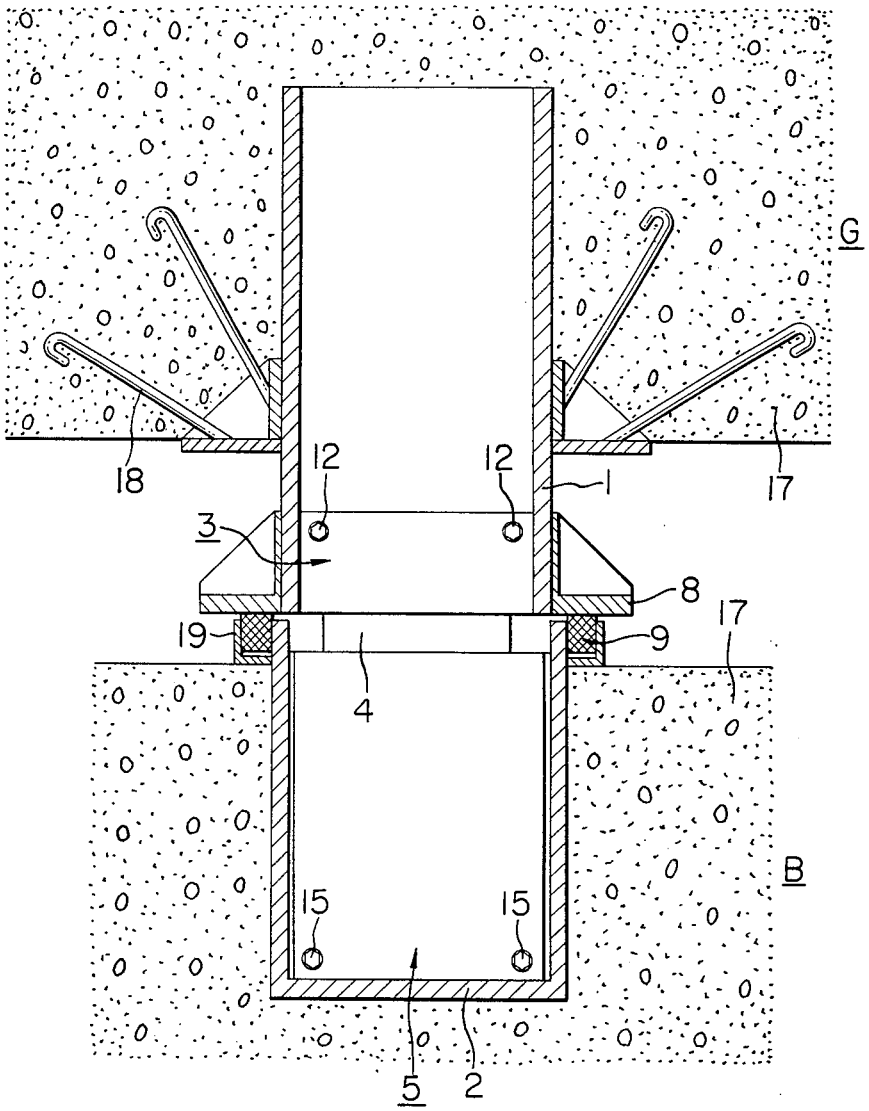

DESCRIPTION OF PREFERRED EMBODIMENT:

Referring to the accompanying drawings and first to FIGS. 3 and 4 which show the shock control device of the invention in sections taken in the transverse and axial directions of the bridge, respectively, the reference numeral 1 denotes a column member which is securely fixed to an upper structure G of a bridge by fixedly anchored in a girder as shown, for example. Indicated at 2 is a casing which is fixedly anchored in a lower structure B of the bridge in a pier.

The lower end of the column 1 is fixedly mounted on a movable plate assembly 3 which has a number of uniformly spaced thin plates 4 disposed side by side and securely linked to each other at one end.

Fixedly received at the bottom the casing 2 is a fixed resisting plate assembly 5 having a number of uniformly spaced thin plates 6 which are disposed side by side and securely linked to each other at the lower ends. The movable resisting plate assembly 3 is inserted into the fixed plate assembly 5 in the casing 2 in such a manner that a fixed plate 6 is alternated by a movable plate 4 and the faces of the respective resisting plates 4 and 6 are disposed in the direction of the bridge axis.

The fixed resisting plate assembly 5 is abutted against the inner wall surfaces of the casing 2 at the front and rear sides thereof as seen in the axial direction of the bridge to block its movement at least in the axial direction. The length in the axial direction of the movable plate assembly 3 is smaller than that of the fixed plate assembly 5 which is in abutting engagement at opposite ends with the inner walls of the casing 2, so that the movable plate assembly 3 is movable within the casing 2 in the direction of bridge axis. Gaps 7 are provided on the outer sides of the fixed plate assembly 5 to escape the movable and fixed plate assemblies as a whole when deviated in a direction perpendicular to the bridge axis. An annular lid 8 is securely fixed at the lower end of the column 1 by welding or other suitable means to cover the upper end of the casing 2. The annular lid 8 is slidably engaged with a seal 9 on the circumference of the casing 2 to seal the joint of the casing 2 and the column 1. A viscous material 10 fills the casing 2 including small clearances between the movable and fixed resisting plates 4 and 6. The column 1 and casing 2 are securely anchored in positions on the upper and lower structure of the bridge with use of concrete 17 and reinforcing steel 18. The reference numeral 19 designates a holder for the seal 9. The movable and fixed plates should preferably be of a metallic material such as steel plates but obviously the selection of material depends upon the size of the bridge to be constructed as well as upon the conditions under which the shock control device is to be used.

Figure 5:
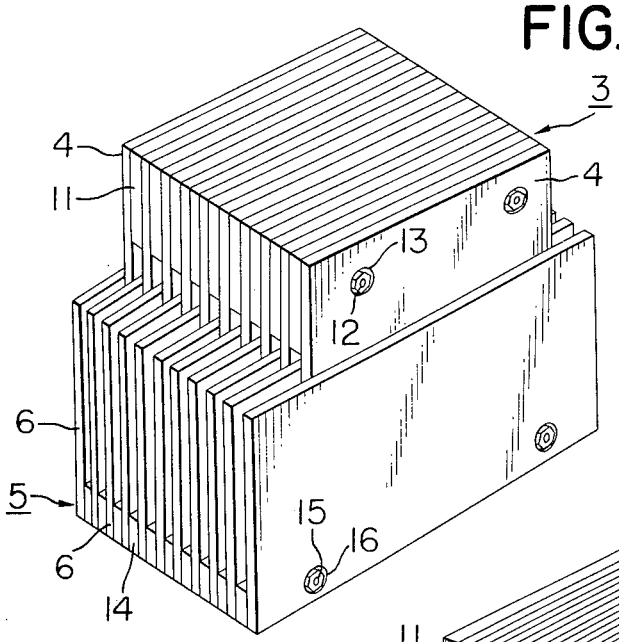
FIG. 5 is a diagrammatic perspective view showing relative positions of assembled movable and fixed resisting plates.

Referring now to FIG. 5 showing the movable and fixed resisting plate assemblies 3 and 5 of FIGS. 3 and 4 placed in the alternately fit positions, the thin plates 4 of the movable plate assembly 3 are uniformly spaced from each other by spacers 11 which is formed from a material same as or different from that of the thin plates 4. The spacers 11 and thin plates 4 are tightly put together by means of bolts 12 and nuts 13.

Figure 6:
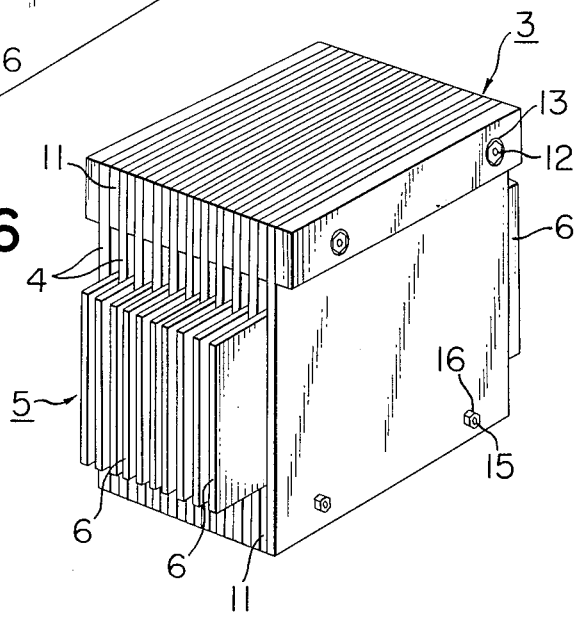
FIG. 6 is a view similar to FIG. 5 but showing a modified construction of the movable and fixed plate assembly.

As mentioned hereinbefore, FIG. 6 shows a modified form of the movable and fixed resisting plate assemblies, where the thin plates 4 constituting the movable plate assembly 3 are uniformly spaced apart likewise by means of a number of spacers 11 and assembled together by bolts 12 and nuts 13 at both the upper and lower ends thereof. While, the thin plates 6 which constitute the fixed resisting plate assembly 5 are inserted into the movable resisting plate assembly 3 in small gap relation with the thin plates 4. In this modification, the thin plates 6 which are inserted into the movable plate assembly 3 are not bolted together and left free to move within the movable plate assembly 3. The thin plates 6 which lie in the axial direction of the bridge have a length greater than the thin plates 4 of the movable plate assembly 3 and therefore have the opposite end portions projected outwardly beyond the front and rear ends of the plates 4 as shown particularly in FIG. 6.

With the modified form of the movable and fixed plate assemblies of FIG. 6, when placed in the casing 2 with the plate faces disposed in the direction of the bridge axis, the plates 6 of the fixed plate assembly 5 are blocked against movement in the axial direction due to abutting engagement with the inner wall surfaces of the casing 2. Also in this modification, it is desirable to provide small gaps between the outermost plates and the casing 2 so that the movable and fixed plate assemblies 3 and 5 are as a whole allowed to move to a certain extent in a direction perpendicular to the bridge axis.

Figure 8:
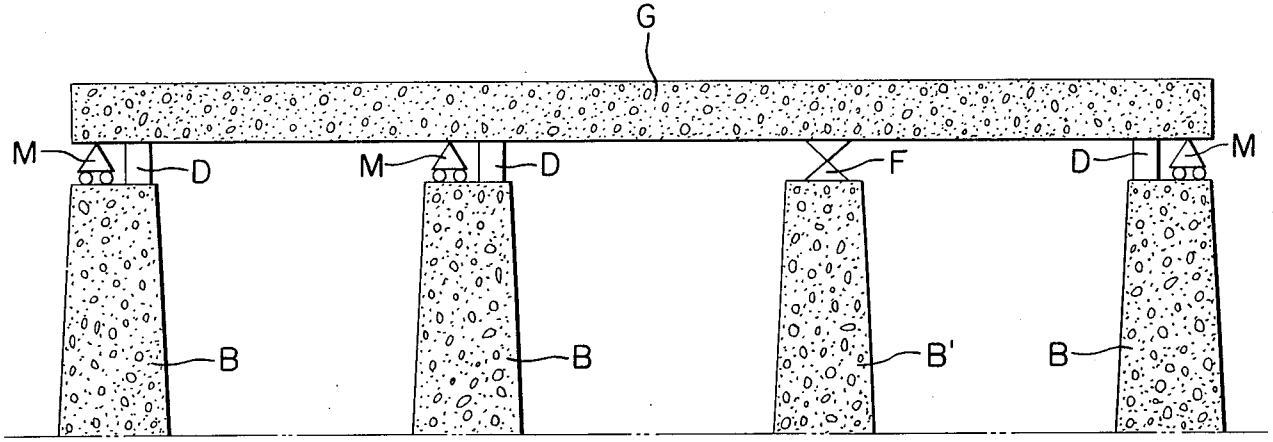
FIG. 8 is a diagrammatic view showing an ordinary bridge supporting system.

Referring to FIG. 8 which illustrates an ordinary bridge support system, the bridge is usually provided on a lower structure or pier B′ with a fixed support or bearing F for fixedly supporting thereon an upper bridge structure G and on another lower structure B with a movable support or shoe (briedge bearing) M for movably supporting the upper structure. The shock control device D of the invention is mounted on the lower structure B in juxtaposition with the movable bearing or shoe (briedge bearing).

With the shock control device of the invention as described above, in response to a movement of the upper structure G, the movable resisting plate assembly 3 which is fixed to the column 1 tends to move in the axial direction of the bridge maintaining small gap relation with the plates 6 of the fixed plate assembly 5. This movement of the movable plate assembly 3 is counteracted by viscous shearing resistance which is generated in the viscous material existing in the interspaces between the plates 4 and 6 of the movable and fixed resisting plate assemblies 3 and 5, according to the velocity of the movement of the movable plate assembly 3. That is to say, when the movement of the movable plate assembly 3 is very slow, the shearing resistance generated in the viscous material is very small or of an ignorable extent. However, as the velocity of the movable plate assembly 3 is increased, the resistance is increased in terms of an exponential function.

The viscous material to be used in the present invention should be of the nature which will not corrode other component parts, has a small vapor pressure, hardly deteriorates in quality and shows little changes in viscosity coefficient under varying temperature conditions. For example, fluidized polymeric material such as polyolefin, pitch or highly viscous silicon or fluorine compounds are most desirable. These viscous material may be used in the form of a mixture or may be added with other organic or inorganic material to attain desired fluidity or to make up for the variations in viscosity coefficient caused by temperature variations.

As a result of experiments using the viscous material a pitch of 3500 poise, the present inventors have found the following relation:

$$F = k\,S(V/C)^m$$

where F stands for the resistance (Kg), S stands for the total effective area ($cm^2$) of the movable plates as demarcated by the fixed plates, V stands for the velocity (cm/sec) of the movable plates, and C stands for the width (cm) of the clearances between the movable and fixed plates. $k$ is a constant which is determined by the viscosity coefficient of the viscous material and $m$ is an exponent which is dictated by the kind of the viscous material to be used, which constant and exponent were 0.05 and 0.5 in the experiments, respectively.

Figure 7:
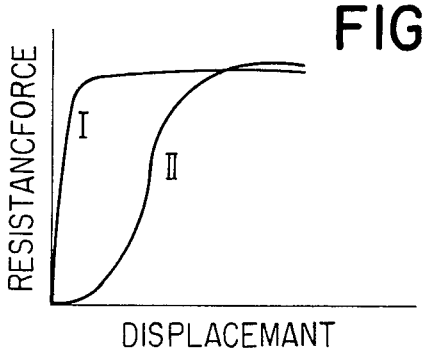
FIG. 7 is a graphic illustration showing the displacement of movable plates in relation with the resistance generated.

FIG. 7 graphically illustrates the relation between the displacement of the movable plate assembly and the resistance generated in the viscous material, where indicated at I is a plot obtained with use of the device according to the invention and at II is a plot obtained by the use of the same viscous material but without the control device of the invention.

The velocity of the movable plate assembly was held constant during the comparative experiments and therefore the displacement of movable plate assembly in the graph of FIG. 7 may be substituted by time. As apparent from FIG. 7, the shock control device of the present invention quickly responds to the movement of the movable plate assembly (in terms of displacement or time), that is to say, a great resistance is generated in response to a movement of small displacement (or of short duration) and without time plays.

Where the movable plate assembly is moved at a varying velocity, the resistance of the viscous material is increased in terms of exponential function as the velocity of the movable plate assembly is increased, as will be clear from the equation given hereinbefore.

In general, earthquakes have a velocity in the range of 10 to 20 cm/sec and even the velocity of earthquakes of great magnitude is in the order of 30 to 40 cm/sec. The velocity of the girder movement caused by a braking or starting vehicle is 2 to 4 cm/sec. On the other hand, the elongation or contraction of the girder which is caused by temperature variations has a far smaller velocity, that is, a few millimeters or smaller per hour. Thus, the shock control device of the invention absorbs and attenuates abrupt and quick movements as caused by an earthquake or a braking vehicle without generating resistance in reply to a slow movement and without imparing the normal functions of the bridge bearings.

The shock control device of the invention which advantageously utilizes the shearing resistance of the viscous material possesses various merits over the conventional device which simply has one end of a column plunged in a viscous material, as summarized below.

1. Substantially no internal pressure is generated by the viscous material;
2. There is no possibility of trapping air in the viscous material;
3. The resistance is generated very quickly;
4. The shock controlling performance is not influenced by deviations from initial positions of the movable and fixed resisting plates;
5. The surface level of the viscous material is not raised by the movable resisting plate assembly and therefore there is no possibility of the viscous material flowing out of the casing; and
6. The resistance can be varied easily by adjusting the width of the clearances between or the area (or the number) of the resisting plates or by adjusting the viscosity coefficient of the viscous material.

The following table shows results of experiments using 1 mm thick resisting plates including movable resisting plates each with an effective area of 1800 $cm^2$ and a viscous material having a viscosity coefficient of 3500 poise. The number of the movable plates, the width of the clearances between the movable and fixed resisting plates and the velocity were varied in each experiment.

| Number of Movable Plates | 1 | | | | 10 | |
|---|---|---|---|---|---|---|
| Clearance (cm) | 0.05 | | 0.1 | | 0.1 | |
| Velocity (cm/sec) | 2 | 10 | 2 | 10 | 2 | 10 |
| Resistance (Kg) | 580 | 1300 | 400 | 900 | 4000 | 9000 |

What is claimed is:

1. A shock control device for use in the construction of buildings such as bridges and the like, comprising:

a casing fixedly mounted on a lower structure;

resisting plates received in said casing and having a number of movable and fixed plates alternately and in small interspace relation with each other;

said movable plates being linked to each other at least at the upper ends with uniform spaces from adjacent plates;

said fixed plates having the front and rear ends thereof abutted against the inner wall surfaces of said casing to block movement at least in the axial direction of said building;

a column member having the lower end thereof fixedly mounted on the upper ends of said movable plates and the upper end securely fixed to an upper structure of said building to be supported on said lower structure; and a viscous material filling the interior of said casing including interspaces between said movable and fixed resisting plates;

said movable plates being movable toward said fixed plates upon application of impact on said upper structure against shearing resistance generated in the viscous material existing in the clearances of said movable and fixed plates.

2. A shock control device as defined in claim 1, wherein said fixed resisting plates are linked to each other at the lower ends thereof.

3. A shock control device as defined in claim 1, wherein said fixed resisting plates are placed in said casing alternately with said movable plates and separately from each other.

4. A shock control device as defined in claim 1, wherein said movable plates and fixed plates are respectively retained in uniformly spaced positions by means of spacers interposed between adjacent plates.

5. A shock control device as defined in claim 2, wherein said fixed resisting plates are linked to each other at the lower ends thereof by means of bolts and nuts.

* * * * *